US005734325A

United States Patent [19]

Johnson et al.

[11] Patent Number: 5,734,325

[45] Date of Patent: Mar. 31, 1998

[54] ALARM DEVICE

[75] Inventors: Raymond C. Johnson, Bonaire; Walter K. Layfield, Warner Robins, both of Ga.; Michael J. Epple, Belair, Md.; Gregory J. Burns, Gasburg, Va.; James J. Walker, Downingtown; Michael J. Grajewski, Pottstown, both of Pa.

[73] Assignee: ICI Americas Inc., Wilmington, Del.

[21] Appl. No.: 541,786

[22] Filed: Oct. 10, 1995

[51] Int. Cl.[6] ..... G08B 13/14

[52] U.S. Cl. ..... 340/568; 340/545; 340/569

[58] Field of Search ..... 340/568, 687, 340/541, 545, 548, 547, 569; 902/1, 9, 41; 232/35–37; 109/25, 29, 31, 38, 39, 43

[56] References Cited

U.S. PATENT DOCUMENTS

| | | | |
|---|---|---|---|
| 3,370,287 | 2/1968 | Gore, Jr. | 340/568 |
| 3,564,525 | 2/1971 | Robeson et al. | 109/25 |
| 3,828,341 | 8/1974 | Carter, Jr. et al. | 340/571 |
| 4,030,087 | 6/1977 | Ritchie et al. | 340/516 |
| 4,118,691 | 10/1978 | Sims | 340/548 X |
| 4,234,879 | 11/1980 | Baker | 340/568 X |
| 4,620,182 | 10/1986 | Keifer | 340/568 |
| 4,814,749 | 3/1989 | Abramson | 340/568 X |
| 4,935,725 | 6/1990 | Turnau | 340/568 |
| 5,001,461 | 3/1991 | Vroom et al. | 340/572 |
| 5,059,949 | 10/1991 | Caparoni et al. | 340/571 |
| 5,410,295 | 4/1995 | Van Lint | 340/568 |

OTHER PUBLICATIONS

Sentrol Products Information Bulletin (date unknown) "1005 Series Magnetic Contacts".

*Primary Examiner*—Thomas Mullen
*Attorney, Agent, or Firm*—Howson and Howson

[57] ABSTRACT

An alarm device for night deposit boxes consists of a housing with a tear gas or dye-releasing alarm in a housing mountable inside the deposit box. The housing includes electrical circuitry, which is connected by a flexible conductor cable to a trigger switch fitting into a magnetic keeper. The keeper is mechanically connected to the deposit box door assembly by a flexible cable. The circuitry includes a key-operated disabling switch and a light-emitting diode which is momentarily energized through a capacitor when the circuit is enabled.

9 Claims, 3 Drawing Sheets

ALARM DEVICE

SUMMARY OF THE INVENTION

This invention relates to anti-theft alarms and particularly to a novel anti-theft alarm suitable for foiling the theft of the contents of bank night depositories and similar boxes and vaults.

Many commercial banks provide night-drop deposit boxes for the convenience of businesses which need to deposit their day's receipts after the close of banking hours. A typical night-drop deposit box is an enclosure built into a bank building and having an access chute accessible through a small door on the exterior wall of the building. A typical box has a front cover which includes not only the access door, but also a movable internal barrier which is mechanically coupled to the access door to prevent removal of already-deposited contents of the box through the access opening when the door is open.

Thieves have discovered that, with the aid of hydraulic jacks or similar devices, it is possible to remove the entire front cover of a typical night-drop box, including the access door, to gain access to the deposited contents. Therefore, there has arisen a need for a means to prevent, or at least foil or discourage, the theft of night deposits in this manner.

The principal object of this invention is to provide a simple and inexpensive alarm device which is capable of foiling or discouraging burglaries of night-drop deposit boxes and other boxes and vaults by the removal of the front cover. Another object of the invention is to provide an alarm device which is easily installed. Still another object is to provide for versatility in installation of the alarm device. A still further object is to provide a self-contained alarm device which has its own electrical power source, an indicator showing that the power source is operative, and an automatic feature which minimizes drain on the power source.

The term "alarm" as used in this specification, refers not only to audible or visual alarms such as sirens, bells, flashing lights and the like, but also to devices designed to foil or discourage burglary, such as smoke generators, and devices for releasing tear gas and/or dye.

In accordance with the invention, in an enclosure, comprising an enclosure having an access door, a device is installed for providing an alarm when the access door is removed. The device comprises an alarm, and trigger means, responsive to removal of the access door from the enclosure, for providing a trigger signal, the trigger means allowing normal opening of the access door without activation of the alarm.

A preferred alarm device in accordance with the invention comprises an electrical trigger switch capable of assuming first and second states, keeper means for holding the trigger switch in its first state when the keeper means is in proximity to the switch, means for causing the trigger switch to assume its second state when the switch is out of proximity to the keeper means, an alarm, electrical circuit means connected to the trigger switch for activating the alarm in response to assumption by the switch of its second state, means for mechanically connecting the keeper means to the protected element, and means for mechanically connecting the trigger switch to the electrical circuit means. At least one of the mechanical connecting means is elongated and flexible.

The preferred alarm device has a self-contained electrical power supply, second switch means for connecting the power supply to the trigger switch, the second switch means being switchable between a first condition in which it connects the power supply to the trigger switch and a second condition in which it disconnects the power supply from the trigger switch, and means for providing an indication that the power supply is active when the second switch is switched from its second condition to its first condition.

In the preferred alarm device, the indicator provides only a momentary indication that the power supply is active, to prevent drain on the self-contained electrical power supply.

Further objects, details and advantages of the invention will be apparent from the following detailed description, when read in conjunction with the drawings.

DETAILED DESCRIPTION

Figure 1:
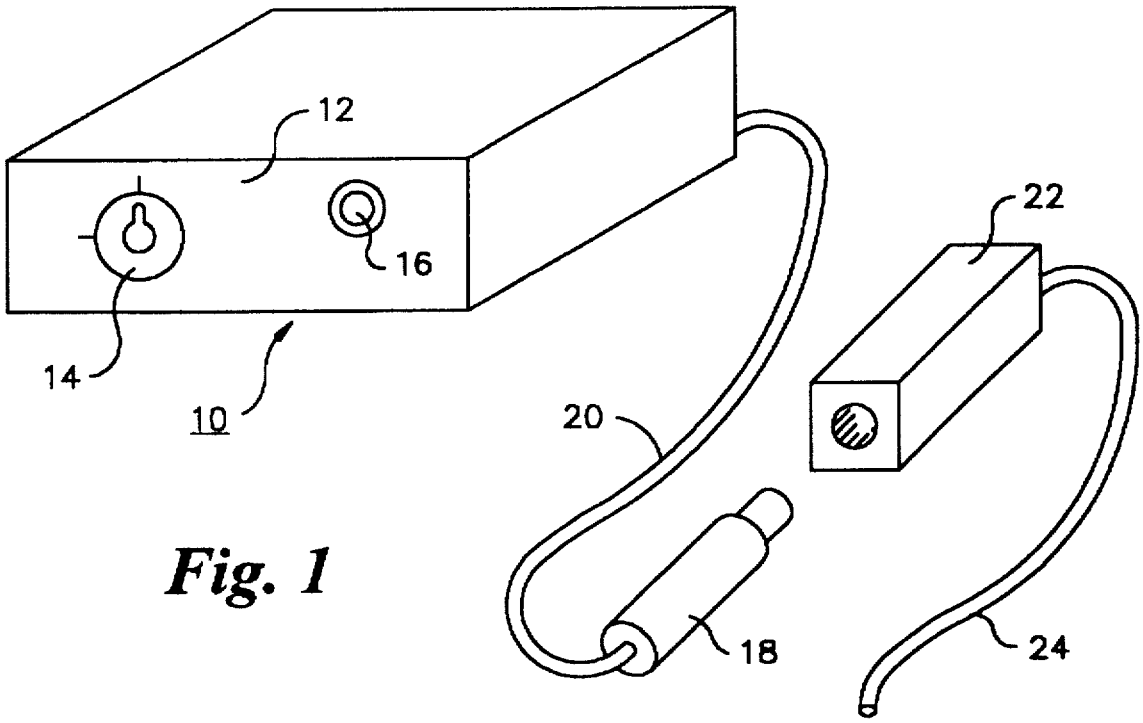
FIG. 1 is a perspective view showing the assembly of the principal components of a preferred alarm device in accordance with the invention.

The alarm device, e.g. the dye release device, its associated electrical circuitry, and a self-contained electrical power supply, are housed in a small metal case 10 shown in FIG. 1. The case 10 can be secured to the interior of a night deposit box, or in a similar box or vault, at an convenient location. The front panel 12 of the case has a key-operated switch 14, which is used to disable the alarm device during installation and servicing, and an indicator lamp 16, preferably a light-emitting diode (LED), for indicating that the power supply is operative and properly connected to the trigger switch.

The trigger switch 18 is a single pole, double-throw reed switch, connected to electrical circuitry within housing 12 by an elongated, three-conductor, flexible, insulated cable 20. The reed switch is housed in a cylinder of plastics material. Its movable element is connected to a first switch terminal. The movable element is resiliently urged into contact with a second switch terminal, but a magnetic field can cause the movable element to move into contact with a third switch terminal.

The keeper 22 is a housing having an opening receiving the cylinder containing the reed switch and has an internal permanent magnet which holds the movable element of the reed switch in electrical contact with the third switch terminal when the cylinder is in the opening of the keeper. The cylinder fits frictionally in the opening of the keeper, but can be removed from the keeper by a small force only slightly exceeding the weight of the reed switch, its cylinder and its associated electrical cable 20.

The keeper 22 is connected to a flexible lanyard 24, preferably a stranded metal cable, the opposite end of which is attached to the cover assembly of the box.

Figure 2:
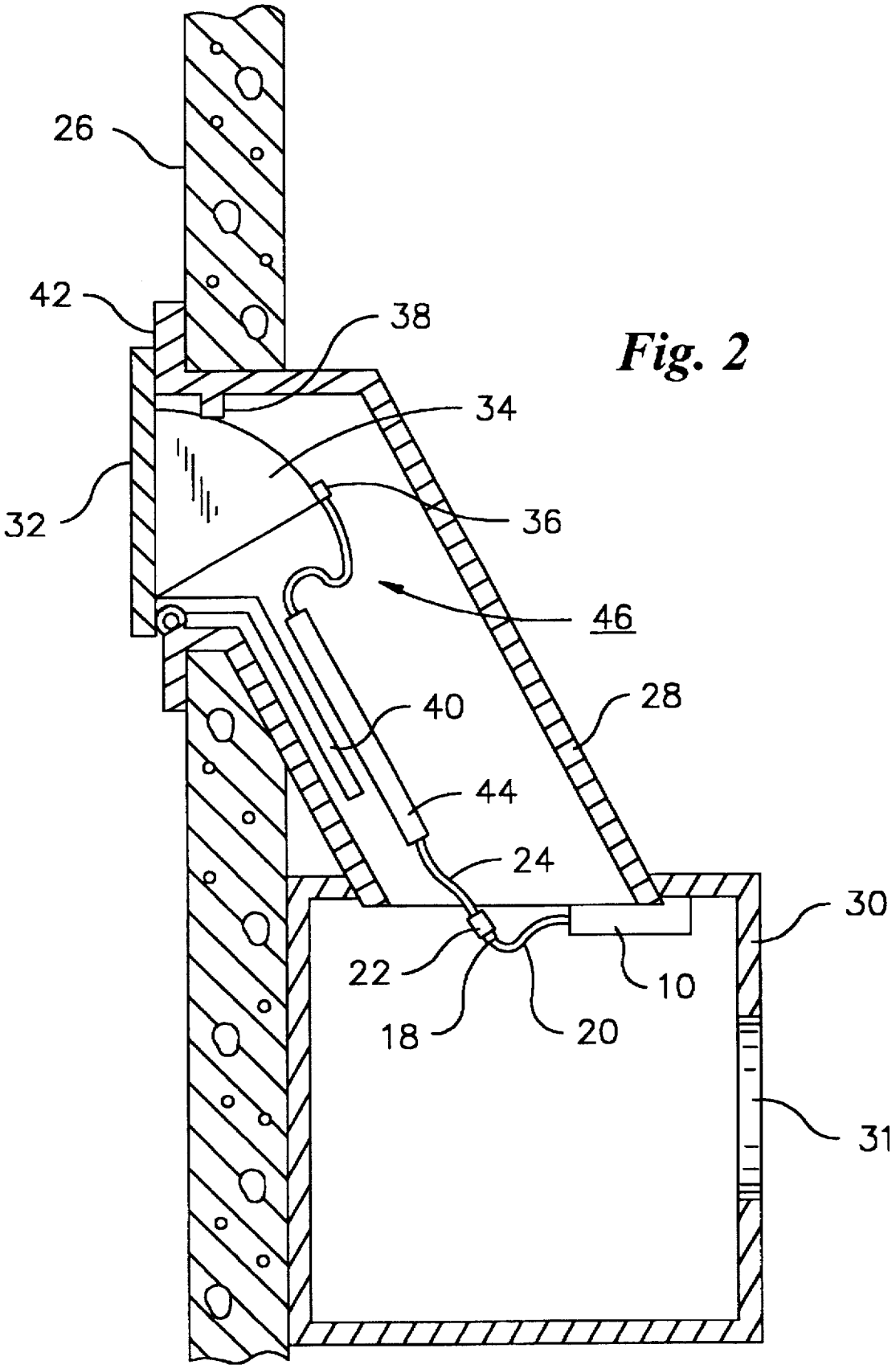
FIG. 2 is a sectional view of a night-drop deposit box equipped with the alarm device of FIG. 1.

As shown in FIG. 2, the case 10, trigger switch 18 and keeper 22 are associated with a conventional night-drop deposit box. The night deposit box is typically installed in the wall 26 of a bank building, and comprises a chute 28 and a receptacle 30 having a top opening receiving the lower end of the chute, and a side opening 31 accessible from the interior of the bank building. The upper end of the chute extends through the wall and is normally closed by an access door or "head" 32, which is hinged at its lower edge so that it can swing down when a deposit is to be made. A pair of laterally spaced side panels, one of which is shown at 34, is attached to the rear of the door 32 to prevent the bags being deposited from jamming as the door is closed. Side panel 34 may be provided with a projection 36, which engages with a projection 38 on the inside of the chute to limit the downward swing of the door.

Also attached to the lower end of the inside face of the door is barrier 40, which swings upward as the door is opened to close off the chute. This panel prevents burglars from reaching down into the receptacle 30 with grasping tools when the door is opened. The barrier 40 is shown simplified. In practice, the barrier is usually interconnected with the door by a motion-amplifying linkage which causes the panel to move up to close off the chute when the door is just slightly opening.

As mentioned previously, burglars have discovered ways to remove the entire front cover of a typical night-drop box, including the access door, to gain access to the deposited contents. Typically, this is accomplished by using hydraulic jacks to pull the panel 42 surrounding the door away from the wall 26. This removes the entire door assembly, including the door 32, its surrounding panel 42 and the barrier 40, thereby making it possible for the burglar to reach into the receptacle 30 with grappling tools to remove bags of currency, checks, etc.

In accordance with the invention, the alarm housing 10 is attached to the interior of the receptacle 30, and is connected to the door assembly of the night-deposit box through electrical cable 20, trigger switch 18, keeper 22 and lanyard 24, the latter being held against the wall of the chute by a tape 44, and having a loop at 46 to permit the door to open without dislodging the keeper 22 from trigger switch 18. The tape 44 keeps the lanyard from being engaged by materials being deposited. The keeper and trigger switch are likewise preferably positioned out of the path of deposited materials. The loop 46 allows the lanyard to be attached directly to the side panel 34, which moves with the door. This allows the apparatus to be installed more easily than would be the case if a direct connection were to be made to the fixed, door-surrounding panel 42.

When the door is opened in the normal manner by a depositor, the keeper and trigger switch remain engaged with each other. However, when the door assembly is removed by pulling on the door surround panel 42, the lanyard pulls the keeper away from the switch, thereby triggering the alarm.

Figure 3:
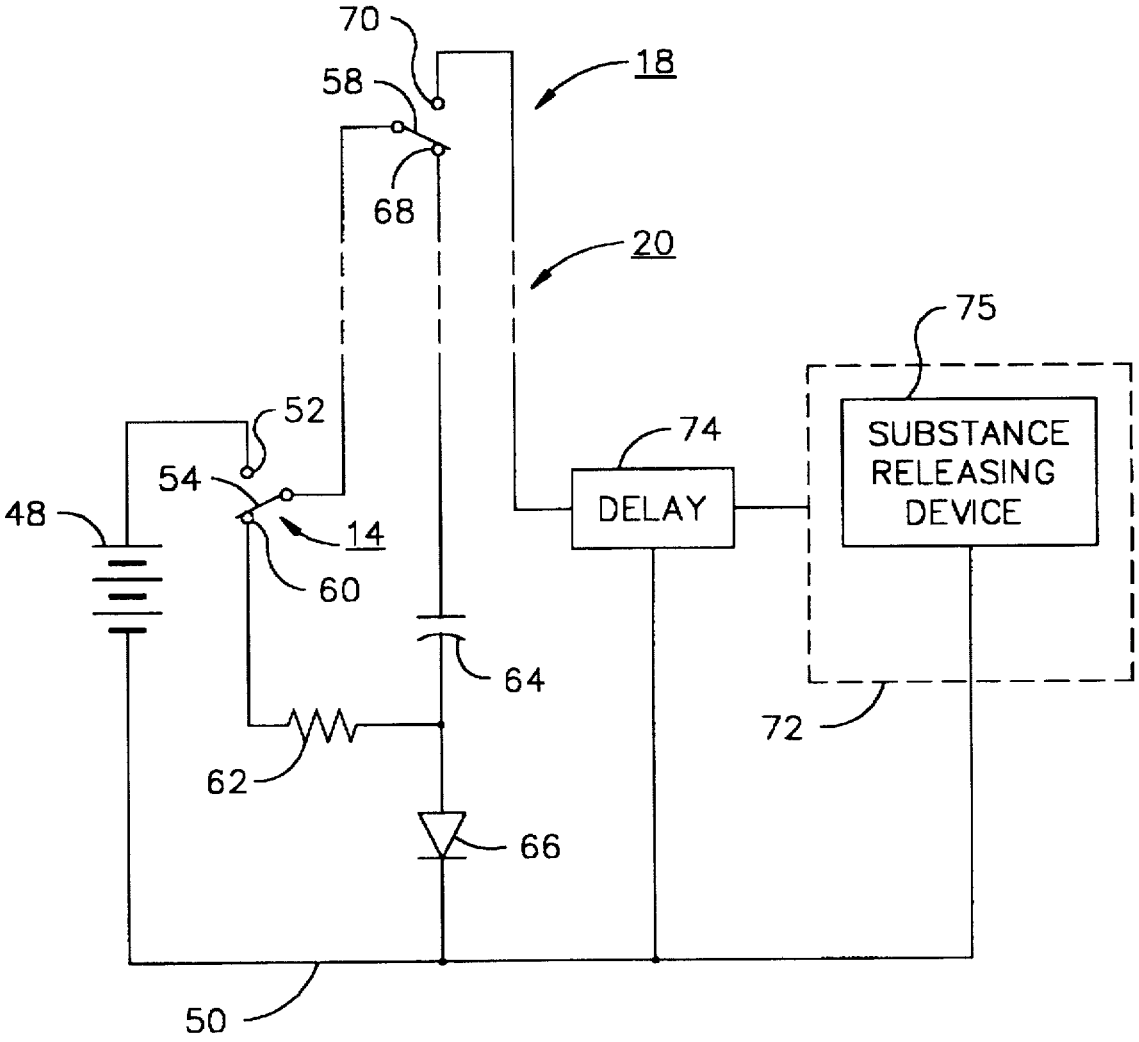
FIG. 3 is an electrical schematic of the alarm device.

Referring to FIG. 3, the alarm circuit includes a self-contained electrical power supply 48, which may be a conventional dry cell battery. The positive terminal of the power supply 48 is connected to a common conductor 50, and the other terminal of the power supply is connected to a contact 52 of key-operated switch 14, which is a single pole, double-throw switch. The movable contact 54 is connected to the movable contact 58 of trigger switch 18, which is also a single pole, double throw switch.

The connections to switch 18 are made through flexible cable 20, which is a three-conductor cable.

Contact 60 of switch 14 is connected through resistor 62 to the junction of capacitor 64 and the anode of light-emitting diode (LED) 66. The cathode of LED 66 is connected to the common conductor 50, and the other side of capacitor 64 is connected through one of the conductors of cable 20 to fixed contact 68 of trigger switch 18.

The other fixed contact 70 of trigger switch 18 is connected to an alarm device 72 through a delay circuit 74. The alarm can include a substance-releasing device 75, such as a smoke or tear-gas generator, a dye-release device, or alternatively, an audible or visual alarms such as a siren, bell, flashing light or the like. The delay circuit is preferably a conventional capacitor-charging circuit which triggers an SCR (silicon controlled rectifier) through a unijunction transistor, diac, or other avalanche device. The purpose of the delay circuit is to introduce a delay, for example ten seconds, between the time the trigger switch is operated and the time the alarm is operated. This delay makes it more likely that the burglar will have attempted to reach for the contents of the box, and be exposed to the dye or tear gas when the alarm operates.

In the operation of the circuit of FIG. 3, switch 18 is normally in the position shown, with its movable contact 58 connected to contact 68. Trigger switch 18 is spring-loaded and thereby urged to the condition in which movable contact 58 is in contact with fixed contact 70. However, normally the keeper maintains the switch in the condition shown. Key-operated switch 14 is shown in the inactive position, but when it is set, moving contact 54 is connected to contact 52. When the keeper is removed from the trigger switch, contact 58 moves to contact 70, thereby connecting the power supply 48 directly to the delay device 74, whereupon, after the predetermined delay interval, the alarm 72 is operated.

If the keeper is reconnected to the trigger switch during the delay interval, the alarm may or may not be activated, depending on the details of the delay circuit. In the case of a conventional capacitor-charging, SCR, unijunction transistor circuit, reconnection during the early part of the delay interval will reset the circuit. However, reconnection during the latter part of the delay interval may cause the potential drop across the base connections of the unijunction transistor to drop to a level such that the emitter goes into conduction. Under these circumstances, reconnection may not prevent the alarm from being triggered.

The condition of the self-contained power supply and its connection to switch 18 can be checked by observing the LED when switch 14 is operated. In the position shown, switch 14 keeps capacitor 64 discharged. However, when its moving contact 54 is connected to contact 52, capacitor 64 begins to charge. The charging current lights LED 66 momentarily until the charge builds up on capacitor 64. Thereafter the current in capacitor 64 and LED 66 diminishes toward zero, and the drain on power supply 48 is virtually non-existent.

In the normal use of the night deposit box, the door can be opened and closed without triggering the alarm. However, removal of the door assembly will pull the keeper 22 away from trigger switch 18, causing the alarm to operate after a predetermined delay. In the case of a dye-releasing alarm, the dye will mark the deposited bags and the currency in the bags, making them identifiable as stolen. The dye may also come into contact with the perpetrators, directly if they reach into the deposit box, or indirectly if they handle the dyed bags. In the case of a tear gas alarm the released tear gas will discourage handling of the bags. Tear gas and dye can, of course, be combined in a single alarm.

One of the significant advantages of the invention is that it is self-contained and therefore can be easily installed in an existing deposit box or other box or vault without wiring the device to an electrical line. The use of a flexible cable to connect the keeper to the door, and a flexible conductor to connect the trigger switch to the alarm provide a high degree of versatility, making it possible for a given alarm apparatus to be installed in any of various different boxes and vaults.

The invention is applicable not only to night deposit boxes but also to various other boxes and vaults, including automatic teller machines, mailboxes and courier package depositories.

Various modifications can be made to the apparatus described. For example, while the preferred trigger is a reed switch and the keeper is a magnet, various other forms of trigger device can be used, including mechanical switches, optical devices, capacitive or inductive sensors, and motion, vibration and acceleration sensors.

While the trigger switch is preferably connected to the electrical circuit through an elongated, flexible conductor and the keeper is preferably connected to the cover assembly of the box through a flexible cable, one or the other of these flexible connections can be eliminated. For example, the trigger switch 18 can be fixed to the housing 12, or the keeper can be fixed to the cover assembly.

While a capacitive-charging delay circuit is preferred, various forms of devices, such as oscillator-counter circuits, can be used.

In still another modification of the apparatus described, the lanyard 46 can be connected directly to the fixed panel 42 surrounding the door, instead of to a movable element.

Still other modifications can be made to the apparatus described without departing from the scope of the invention as defined in the following claims.

We claim:

1. In a box comprising an enclosure having an access door, a device for providing an alarm when the access door is removed, comprising:

an alarm;

trigger means, responsive to removal of the access door from the enclosure, for providing a trigger signal;

the trigger means allowing normal opening of the access door without activation of the alarm.

2. In a box comprising an enclosure having an access door, an alarm device for providing an alarm when the access door is removed, comprising:

a first trigger element comprising an electrical switch capable of assuming first and second states;

a second trigger element comprising keeper means for holding the switch in its first state when the keeper means is in proximity to the switch;

means for causing the switch to assume its second state when the switch is out of proximity to the keeper means;

an alarm;

electrical circuit means, connected to the switch, for activating the alarm in response to assumption by the switch of its second state;

mechanical connecting means for connecting at least one of the trigger elements to the enclosure and the other trigger element to the access door; and said mechanical connecting means allows normal opening of the access door without separation of the electrical switch from the keeper means.

3. A box and alarm device according to claim 2 in which the alarm comprises means for releasing at least one substance from the group consisting of dye, tear gas and smoke.

4. A box and alarm device according to claim 2 in which said electrical circuit means comprises delay means for causing activation of the alarm only after a predetermined interval following assumption by the switch of its second state.

5. A box and alarm device according to claim 2 including disabling means for preventing activation of the alarm, and means for preventing unauthorized persons from operating the disabling means.

6. A box and alarm device according to claim 2 in which the box is a bank night deposit box having a front cover which includes both said access door and a fixed part, and in which the mechanical connecting means for connecting the other trigger element to the access door comprises a mechanical link connecting said other trigger element to at least one of the fixed part of the front cover and the access door.

7. A box and alarm device according to claim 2 in which the box is a bank night deposit box having a front cover which includes both said access door and a fixed part, and in which the mechanical connecting means for connecting the other trigger element to the access door comprises a flexible cable connecting said other trigger element to at least one of the fixed part of the front cover and the access door.

8. A box and alarm device according to claim 2 in which the box is a bank night deposit box having a front cover which includes both said access door and a fixed part, and in which the mechanical connecting means for connecting the other trigger element to the access door comprises a flexible cable connecting said other trigger element to the access door.

9. A box and alarm device according to claim 2 comprising means providing a self-contained electrical power supply for supplying electrical power to the electric circuit means, and in which the electric circuit means includes means for providing an indication that the power supply is active, and that the switch is in its first state.

* * * * *